United States Patent [19]

Lee

[11] Patent Number: 4,809,962

[45] Date of Patent: Mar. 7, 1989

[54] FAST-CLAMPING VISE

[76] Inventor: Fung-Chune Lee, P.O. Box 10160, Taipei, Taiwan

[21] Appl. No.: 170,876

[22] Filed: Mar. 21, 1988

[51] Int. Cl.[4] ..... B25B 1/02

[52] U.S. Cl. ..... 269/182; 269/253

[58] Field of Search ..... 269/181, 182, 254 R, 269/253, 257, 246

[56] References Cited

U.S. PATENT DOCUMENTS

| | | | |
|---|---|---|---|
| 214,907 | 4/1879 | Grimmitt | 269/253 |
| 1,452,384 | 4/1923 | Kissendorfer | 269/182 |
| 2,289,051 | 7/1942 | Semerak | 269/63 |
| 2,445,188 | 7/1948 | Saggen | 269/182 |

FOREIGN PATENT DOCUMENTS

| | | | |
|---|---|---|---|
| 857116 | 12/1960 | United Kingdom | 269/182 |

*Primary Examiner*—Frederick R. Schmidt
*Assistant Examiner*—Judy J. Hartman

[57] ABSTRACT

A vise includes: a vise body, a stationary vise jaw secured to the vise body, a movable vise jaw operatively moving in cooperation with the stationary vise jaw as driven by a screw, a pair of half nut portions formed on a pair of shear-like clamping handles which are operatively closed to form a combined nut engageable with the screw by a clutch, or opened to disengage the two half nut portions from the screw for fast movement of the movable vise jaw for quickly clamping a work piece between the movable jaw and the stationary jaw.

5 Claims, 3 Drawing Sheets

FAST-CLAMPING VISE

BACKGROUND OF THE INVENTION

W. A. Semerak disclosed a vise in his U.S. Pat. No. 2,289,051 in which the movable jaw 11 is quickly and easily shifted by grasping of the hand piece 42 so as to clamp a piece of work between the jaws 10 and 11. By means of the hand piece 40 the screw 35 is rotated to move the follower block 31 to allow the teeth 32 to engage the gear 28 to shift the rack associated with the supporting member 25 forcibly in a rearward direction and thereby forcibly urge the movable jaw 11 toward the stationary jaw 10 to clamp the work piece between the jaws.

However, such a conventional vise has the following drawbacks:

1. The hand piece 42 fixed under the movable jaw 11 may obstruct the rotation of another hand piece 40 rotating the screw 35.

2. For saving operation force of the hand piece 40 for rotating the screw 35, the length of the hand piece 40 should be made longer for larger arm of force, thereby influencing the operating inconvenience of an operator or worker who should bend his body downwardly to easily cause his tiredness.

The present inventor has found these drawbacks and invented the present fast-clamping vise.

SUMMARY OF THE INVENTION

The object of this invention is to provide a vise including a vise body, a stationary vise jaw secured to the vise body, a movable vise jaw operatively moving in cooperation with the stationary vise jaw as driven by a screw means, a shear-force-actuated nut means composed of two half nut portions and having a female-threaded hole formed therein for engaging the male-threaded screw means, and a clutch means operatively closing the two half nut portions for engaging the screw means when urging the movable jaw towards the stationary jaw to grasp a work piece between the two jaws or operatively opening the two half nut portions for releasing the screw means from the nut means for the quick movement of the movable jaw with respect to the stationary jaw.

DETAILED DESCRIPTION

Figure 1:
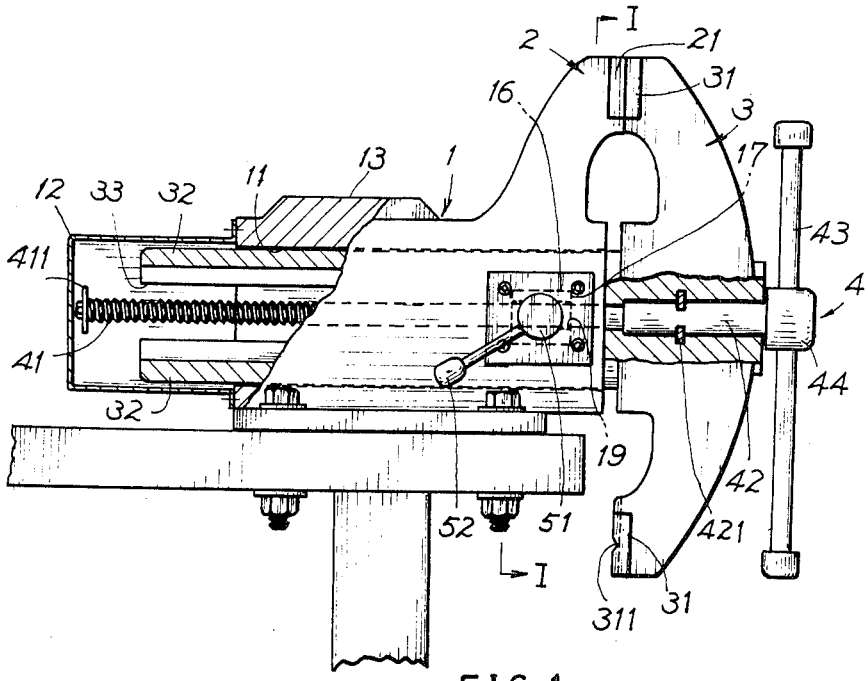
FIG. 1 is a front elevation view of the present invention.

As shown is the figures, the present invention comprises: a vise body 1, a stationary vise jaw 2, a movable vise jaw 3, a screw means 4, a clutch means 5, and a shear-force-actuated nut means 6.

The vise body 1 includes: a longitudinal through hole 11, a rear cover 12 sealing at a rear end portion of the through hole 11, a horizontal platform portio 13 formed on a top portion of the body 1, a side hole 14 transversely formed on a side portion of the body 1 perpendicularly communicated with the longitudinal hole 11 and sealed by a side cover 15, a central guiding member 16 transversely secured to the side cover 15 by screws 151 and having a side end-portion 18 thereof opposite to the side cover 15 secured to the vise body 1 by a screw 181 and having a side wall 17 generally perpendicular to the longitudinal through hole 11 formed with a screw hole 19 therein.

The stationary vise jaw 2 is formed with a clamping pad 21 on a vertical surface of the jaw 2, and protrudes upwardly from the platform portion 13 of the vise body 1.

Figure 5:
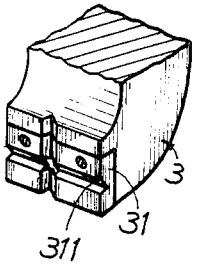
FIG. 5 shows a clamping pad having V-shaped notches of the present invention.

The movable vise jaw 3, includes: a T-shaped block 30 having two clamping pads 31 each formed on an inner vertical surface of any one of the two end portions of the block 30 alternatively facing the pad 21 of the stationary jaw 2, and a bifurcated arm member 32 protruding inwardly from the block 30 having a longitudinal slot 33 longitudinally formed in a central portion of the arm member 32. The longitudinal slot 33 is slidingly engaged with the central guiding member 16 of the vise body 10. The bifurcated arm member 32 is reciprocatively moving within the longitudinal hole 11 of the body 1. One pad 31 is formed with notches 311 thereon such as a cross type notch as shown in FIG. 5.

Figure 6:
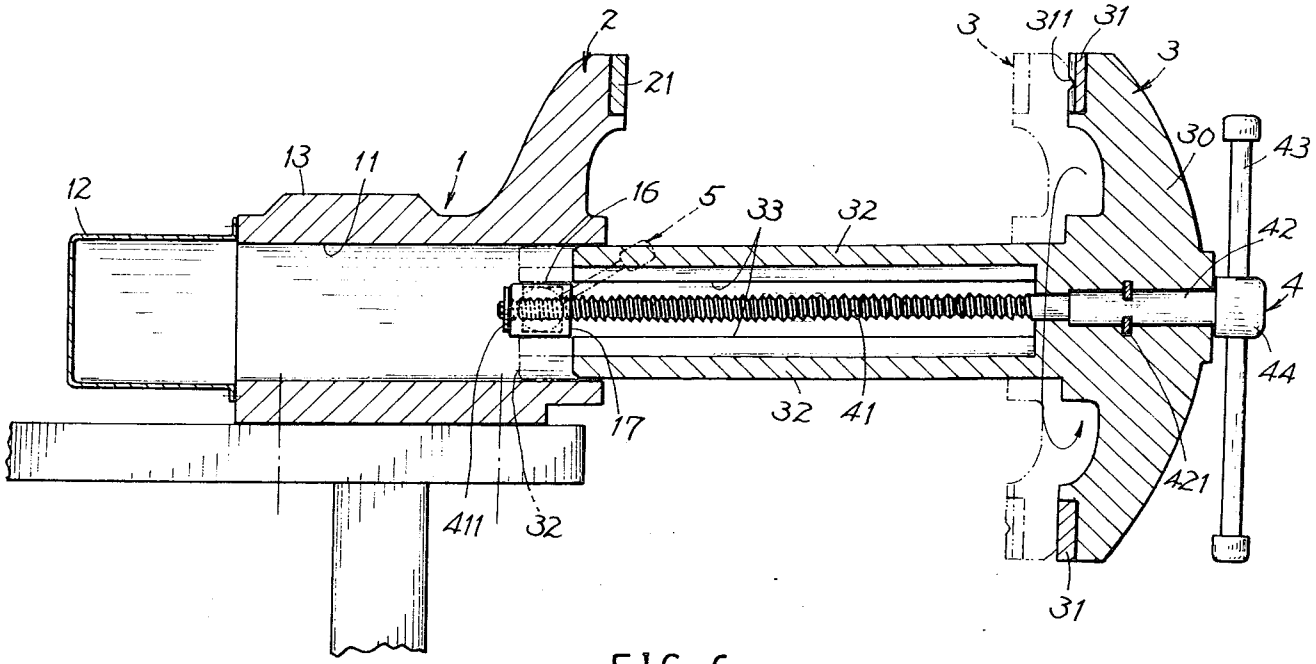
FIG. 6 is an illustration showing the change of the clamping pad from a flat pad to a notched pad when rotating the movable jaw of the present invention.

The screw means 4 includes: a longitudinal screw 41 passing through a screw hole 19 formed on the side wall 17 of the guiding member 16 and disposed within the arm member 32 having a length slighty larger than the length of the bifurcated arm member 32, a screw shaft 42 secured with the screw 41 and rotatably retained in the block 30 of the jaw 3 by a retainer means 421, and a screw handle 43 rotatably driving the screw shaft 42 and screw 41 passing through a screw head portion 44 formed on an outermost end of the screw shaft 42. A limit washer 411 is formed on an innermost end of the screw 41 to limit the screw means 4 without being removed from the vise body 1 as obstructed by the guiding member 16 as shown in FIG. 6. When withdrawing the jaw 3 and screw means 4 outwardly as shown in FIG. 6, the innermost end portion of the bifurcated arm member 32 should be slightly beyond the guiding member 16 and be still held within the hole 11 of the body 1 so that a turn-over rotation (T) of the block 30 may shift a flat pad 31 to a notched pad having notch 311 formed thereon.

The shear-force-actuated nut means 6 includes: a pair of shear-force clamping members 61 each having a half nut portion 62 formed on one end of the clamping member 61 so that two half nut portions 62 are operatively closed or combined to form a nut and having a handle bar 63 divergently protruding from the member 61 in a direction opposite to the half nut portion 62, a fulcrum pin 60 pivotally connecting the pair of clamping members 61 on the side wall 17 of the guiding member 16, and a compression spring 64 resiliently retaining the pair of handle bars 61 for normally closing the two half nut portions 62 to form a combined nut. Inside the two nut portions 62, there is provided with a female-threaded hole 621 engageable with the male-threaded screw 41 so that the combined or closed nut as shown in full line of FIG. 3 will engage the screw 41 which is rotated to reciprocatively drive the jaw 3 in a cooperation relationship with the jaw 2.

The clutch means 5 includes: a cam plate 54 having its center portion secured on a clutch shaft 53 rotatably mounted on the side cover 15 of vise body 1, a clutch head portion 51 formed on an outer end of the shaft 53, and a clutch handle 52 secured to the head portion 51 for rotating the shaft 53 and the cam plate 54. An axis of the shaft 53 is perpendicular to the axis of the screw 41 or an axis of the fulcrum pin 60. The shaft 53 is perpendicular to the cam plate 54. A pair of arcuate slots 55 are respectively eccentrically formed in the plate 54 each slot 55 having an inner slot end 551 disposed on one side of the axis 530 of the shaft 53 at a position proximate to the axis 530 and having an outer slot end 552 disposed on an opposite side of the axis 530 far away from the axis 530. The two arcuate slots 55 are generally disposed on two half portions of the plate 54 such that one slot 55 is generally opposite to the other slot 55 around the axis 530. Each slot 55 is rotatably engaged with each handle bar 63 of the nut means as shown in FIGS. 4 and 3 to operatively "close" the two handle bars 63 (direction R) or "open" the bars (R').

Figure 3:
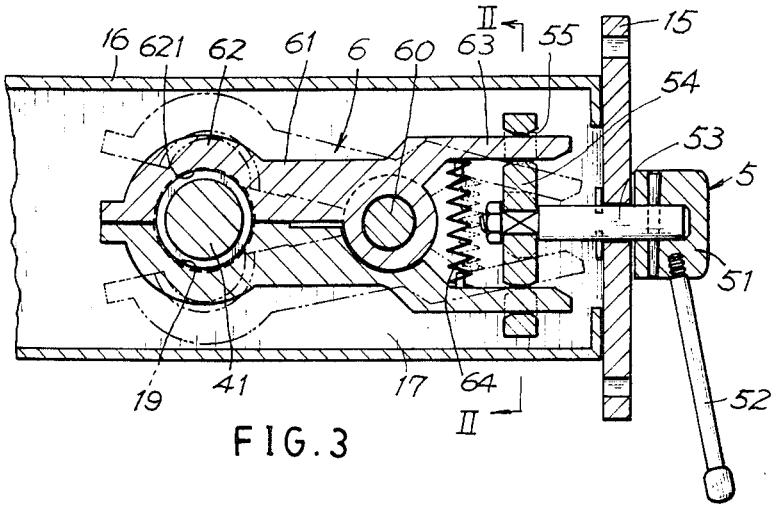
FIG. 3 is an illustration showing the nut means and the clutch means of the present invention.
Figure 4:
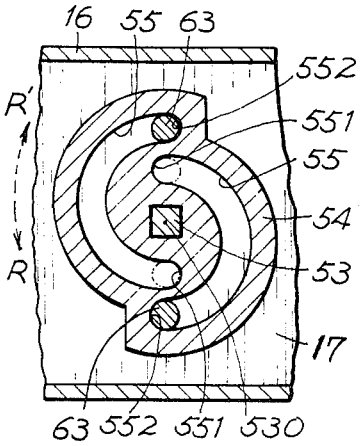
FIG. 4 is a sectional drawing of the present invention as viewed from II—II direction of FIG. 3.

When using the present invention to clamp a work piece ready for processing, the clutch handle 52 is clockwise rotated to rotate the plate 54 in direction R' (FIG. 4) to "close" the two handle bars 63 and "open" the two half nut portions 62 as shown in dotted line of FIG. 3 so that the screw 41 is not engaged by the nut means 6, whereby upon a pushing of the movable jaw 3 inwardly towards the stationary jaw 2, the work piece can be fast clamped between the two jaws 2, 3. Then, the clutch handle 52 is rotated counter-clockwise to rotate the plate 54 in direction R' to "open" the two bars 63 and "close" the two half nut portions 62, whereby a rotation of the screw handle 43 may rotate the screw 41 engaged with the nuts 62 to forcibly urge the jaw 3 to tightly clamp the work piece between the jaws 2, 3.

When it is intended to clamp a round article such as a pipe, the jaw 3 is outwardly withdrawn and the notched pad 311 of the jaw 3 is rotated upwardly as shown is FIG. 6 for firmly clamping the round article between the jaws without causing slippery of the clamped work piece.

Figure 2:
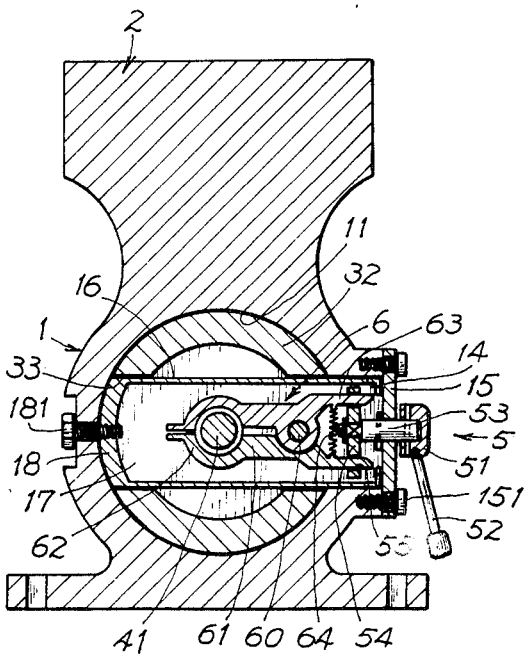
FIG. 2 is a side-view sectional drawing of the present invention as viewed from I—I direction of FIG. 1.
Figure 7:
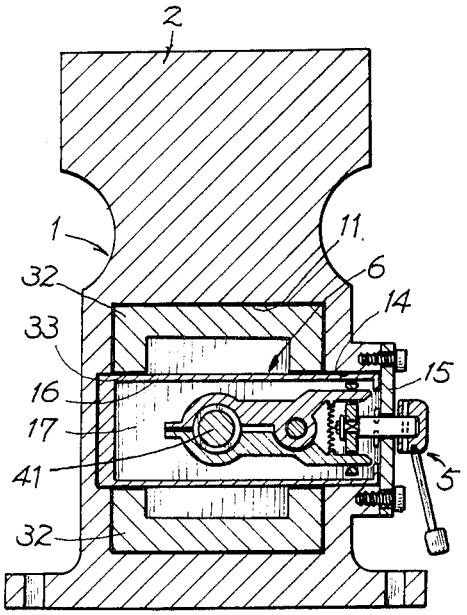
FIG. 7 is an alternate embodiment of the invention in which the vise body and the arm member of the jaw are rectangular in shape.

The longitudinal hole 11 of vise body 1 and the arm member 32 of the jaw 3 are made as circular shape as shown in FIG. 2. However, the longitudinal hole 11 and the arm member 32 may be modified to be a rectangular or square shape as shown in FIG. 7. By the way, if for changing the flat pad to be a notched pad 311 as shown in FIG. 6, the washer 411 should be dismantled and the square-shaped arm 32 of the jaw 3 must be completely withdrawn outside the vise body for the turn-over of the jaw 3 since the square arm 32 is not rotatable within the square hole 11 as shown in FIG. 7.

The present invention is superior to the conventional Semerak's vise because the operation for driving the present two handles 43, 52 can be conveniently done by a worker without bending his body downwardly. Meanwhile, during the fast moving of the movable jaw 3 and the screw 41 when "opening" the two half nut portions 62, the jaw 3 can be faster moved than the Semerak's device because his arm 25 is still engaged with the gear 28 as shown in his FIG. 1.

I claim:

1. A fast-clamping vise comprising:

a vise body having a longitudinal hole longitudinally formed through the body and a central guiding member transversely formed in said body to be perpendicular to said longitudinal hole;

a stationary vise jaw secured on a top portion of said vise body having a clamping pad formed on a vise surface;

a movable vise jaw having a bifurcated arm member protruding inwardly from a jaw block reciprocatively moving within said longitudinal hole of said vise body, a longitudinal slot being longitudinally formed in a central portion of said bifurcated arm member to slidingly engage with said guiding member;

a screw means having a longitudinal male-threaded screw disposed within said bifurcated arm member and secured to a screw shaft rotatably secured with said movable jaw, and having a screw handle secured to an outer end of the screw means for rotating said screw;

a shear-force-actuated nut means having a pair of half nut portions each formed with a female - threaded hole engageable with said screw and a pair of shear-force clamping handles respectively secured with said two half nut portions and pivotally secured on the guiding member, and two handle bars resiliently retained by a compression spring between the two bars each bar secured to each said clamping handle at an end opposite to each said half nut portion, said two half nut portions operatively combined or closed to engage said screw when opening said two handle bars; and a clutch means having a cam plate secured to a clutch shaft rotatably mounted on a side cover of said vise body and driven by a clutch handle mounted on an outer end of said clutch shaft, said cam plate having two arcuate slots generally eccentrically disposed on two half portions of said cam plate opposite with each other, each said arcuate slot having an inner slot end thereof disposed on one side of and proximate to an axis of said clutch shaft and having an outer slot end thereof disposed on the other side of and far away from said axis of said clutch shaft, said arcuate slot rotatably engaged with each said handle bar of said nut means, whereby upon a rotation of said clutch shaft and said cam plate to move each said handle bar in each said arcuate slot from an outer slot end towards an inner slot end, the two handle bars are closed to open the two half nut portions to disengage the nut portions from the screw for fast moving of said screw means and said movable vise jaw.

2. A vise according to claim 1, wherein said movable vise jaw is formed with a T-shaped block, two clamping pads being respectively formed on two end portions of said T-shaped block, one of the two pads being made flat and the other one pad being formed with notches therein.

3. A vise according to claim 1, wherein said longitudinal hole and said bifurcated arm member are each made as a circular shape of its cross section.

4. A vise according to claim 1, wherein said longitudinal hole and said arm member are each made as a rectangular or square shape of its cross section.

5. A vise according to claim 1, wherein said screw has a washer formed on its innermost end to limit the screw from being withdrawn from said vise body, said longitudinal hole of said vise body and said bifurcated arm member being made as circular shape of the cross section thereof, said bifurcated arm member having an innermost end portion positioned beyond said guiding member but still held within said longitudinal hole of said body when uttermostly withdrawing said T-shaped block of said movable jaw beyond said stationary jaw so that upon the rotation of said movable jaw along the axis of said screw, a flat clamping pad formed on one end portion of the T-shaped block is changed to a notched pad.

* * * * *